US006161381A

United States Patent [19]

Lohrmann

[11] Patent Number: 6,161,381

[45] Date of Patent: Dec. 19, 2000

[54] STIRLING ENGINE

[75] Inventor: Tim Lohrmann, Schwerte, Germany

[73] Assignee: SIPRA Patententwicklungs- u. Beteilgungsgesellschaft mbH, Albstadt, Germany

[21] Appl. No.: 09/155,505

[22] PCT Filed: Aug. 21, 1997

[86] PCT No.: PCT/EP97/01428

§ 371 Date: May 6, 1999

§ 102(e) Date: May 6, 1999

[87] PCT Pub. No.: WO97/37119

PCT Pub. Date: Oct. 9, 1997

[30] Foreign Application Priority Data

Mar. 29, 1996 [DE] Germany ..... 196 12 616

[51] Int. Cl.[7] ..... F01B 29/10

[52] U.S. Cl. ..... 60/523; 60/524

[58] Field of Search ..... 60/517, 524, 523

[56] References Cited

U.S. PATENT DOCUMENTS 5,664,945 9/1997 Maynard et al. ..... 60/524 X 5,755,100 5/1998 Lamos ..... 60/524 X

FOREIGN PATENT DOCUMENTS 0093939 7/1980 Japan ..... 60/524

046447 7/1986 Japan .

226547 3/1987 Japan .

7501340 8/1976 Netherlands .

*Primary Examiner*—Hoang Nguyen

*Attorney, Agent, or Firm*—Michael J. Striker

[57] ABSTRACT

In a Stirling engine with a cylinder head which can be heated, with a plurality of heating pipes bent in approximately U shape and with a cooler the the heat transfer to the heating pipes and the efficiency of the cooler are improved. This For this purpose the outwardly directed pipe sections (4*c*) of the heating pipes (4) through which the working medium flows are provided at least locally with a ceramic backing (11) for optimization of the flow (10) of the heating gas and the cooler is in the form of a light metal body (20) with radial ribs (23) within a pot-like housing (21), through which cooling water flows. The spacing of the radial ribs (23) from one another is greater than the gap (25) between the pot inner wall and the outer radial ribs bounding wall.

10 Claims, 3 Drawing Sheets

STIRLING ENGINE

BACKGROUND OF THE INVENTION

This invention relates to a Stirling engine with a cylinder head which can be heated with a plurality of heating pipes bent in approximately U shape and with a cooler for the working gas.

Stirling engines are known in a number of forms; DE 4 016 238 C2 is here cited as an example, as a combination of such an engine with a boiler installation.

The basic principle of such a Stirling engine consists in that a constant volume of gas (helium is used mostly today) is forced to and fro within the Stirling engine by two pistons. On the one side the helium is heated in the heating pipes by the flame of a gas burner and the other side is cooled by a cooler. In between there is a regenerator, which extracts heat from the gas in its path from the hot side to the cold and feeds it back during the return flow. A gearbox connects the two piston so that power can be taken off, e.g. through generators. The pistons are moved alternately in parallel with or in opposition to one another, whereby the gas is compressed by the one piston and expanded again after the heat input by the other.

In addition to mechanical problems there is a perceived problem area on the one hand in optimizing the transfer of heat from the flame of the burner to the heating pipes and on the other hand in optimizing the cooler. A Stirling engine is known from DE 2 821 164 A1. The hot gas engine disclosed there is concerned not with the energy problems in the foreground here and this applies also to other solutions described in the state of the art. Thus for example DE 3 444 995 A1 shows a cyclone device with corresponding flow engines.

Furthermore, coolers are known from DE 4 232 555 A1 or for example from DE 4 401 247 A1 whose cooling bodies are provided with an outer, surrounding, helical groove traversed by the coolant. Such cooling bodies provided with a helical groove are comparatively expensive to make and in addition the coolant is always heating up as it passes through the helical groove, so that such cooling bodies cannot be optimally designed.

SUMMARY OF THE INVENTION

The object of the invention is to optimize the energy balance in a Stirling engine, and to improve the transfer of heat at the heating pipes and the efficiency of the cooler.

This object is met according to the invention in a Stirling engine of the kind initially defined in that the outwardly facing pipe sections of the heating pipes through which the working medium flows are provided at least locally with a ceramic backing for optimization of the flow of the heating gas.

With the construction here under discussion a heater usually comprises two coaxial rows of pipes, which are arranged concentrically in circular form and are joined by pipe bends into U-shaped heater pipes, wherein the pipes are connected at one end to the expansion chamber and at the other end to the regenerator.

The pipe rows arranged in a circle are favorably alongside each other in terms of heat transfer technology on the inside but the outer pipe rows are automatically spread apart because of the geometrical situation, so that the exhaust gas flow slows down in the interstices and the heat transfer becomes worse. As also shown in the reference defining the type in question, assistance has been obtained previously in that the outer pipes are designed as ribbed pipes, in that heat transfer ribs are soldered on for example, which necessarily involves substantial costs and thus cannot be justified economically.

Through the backing according to the invention with ceramic flow guiding elements, as representing a ceramic backing, optimization of the flow around the outer pipes is achieved with economically acceptable means.

The elements of the ceramic backing are advantageously formed from ceramic profiled elements approximately T-shaped in cross-section, where the T limb projects from the outside inwardly between adjacent pipes and the T crosspiece covers the pipes locally on the outside. At this point it should be noted that flow guiding elements on cooling pipes are known per se, such as is shown by JP 61-226 547-A for example.

In order to ensure defined flow channels between the outer surfaces of the outer pipes and the ceramic backing, the invention provides an arrangement in which the inner surface is provided with spacers especially in the transition region from the T limb to the T crosspiece, to flow gaps for the circulation or through-flow. Such spacers can involve small webs cast in the ceramic, if desired equally point-wise applied ceramic knobs or ceramic spots or the like.

It can also be provided according to the invention that the curved head region of the heating pipes is provided with a ceramic ring cover, where the ceramic ring cover is so provided with a head disc with flow webs that there is no space between the inner surface of the ring cover and the outer surface of the curved head region, in order to optimize the transverse flow through the free spaces of the outer pipes.

In order to optimize the cooling capacity of the cooler the invention provides that the cooler is in the form of a light metal body with radial ribs within a pot-like housing and through which cooling water flows, wherein the spacing of the radial ribs from one another is greater than the gap between the pot inner wall and the outer radial ribs bounding wall. This cooling block facilitates particularly good cooling in that the complete flow is ensured through the gaps between the radial ribs.

In order to ensure that the cooling water only passes through a particularly short path inside the cooler for good cooling, the invention provides that at least two grooves bridging over all radial ribs are provided on the periphery to form the coolant inflow and coolant outflow. Thus the cooling water can be distributed to all gaps between the cooling ribs through the one groove in the cooler and the cooling water be taken off at the opposite groove, so that each cooling water portion flows round practically half a circle. Long paths associated with known helical cooling ribs are thus reliably avoided.

Inwardly offset through bores or axial ribs can be provided according to the invention for the working gas to be cooled.

In order to deal with a scaling problem between the housing pot receiving the cooling body and the cooling body with simple means, the invention provides that the cooling body is provided at least at its bottom surface corresponding to the pot bottom with ring seals.

A further structurally simple design consists in that the cooling body comprises an outwardly projecting sealing collar with a ring seal at its edge surface facing the heater. Thus ring seals can be used as scaling means without being subject to any axial requirements. Naturally suitable scale can be provided on the cylindrical outer wall of the cooling body to supplement the ring seals.

In order to be able to prevent or deal with possible leaks the invention provides a design in which the edge region of the housing cooperating with the collar of the cooler is provided with drainage.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
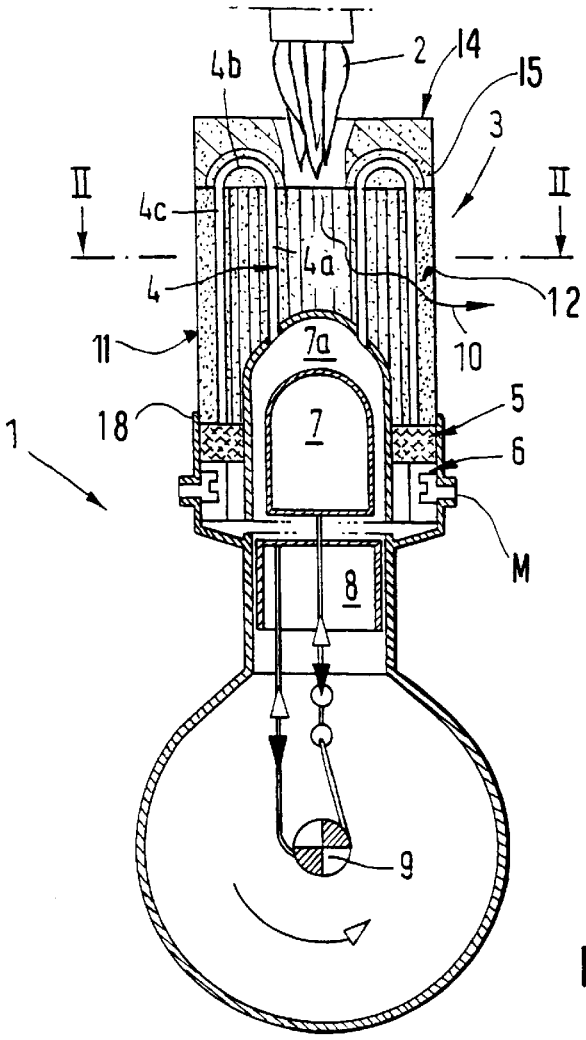
FIG. 1 is a simplified cross sectional view of a Stirling engine with heater pipes and cooler.

The Stirling engine shown greatly simplified in FIG. 1 and generally denoted 1 comprises a cylinder head generally denoted 3 heated by a burner flame, with a plurality of U-shaped curved heater pipes 4, an outlined regenerator 5, an adjoining cooling body 6, a displacer piston 7, a working piston 8 and a gearbox 9, the latter not being dealt with in any detail.

The cylinder head 3 heated by the flame 2 comprises a plurality of heater pipes 4, as already stated above, which are formed from inner, in relation to the cylinder head, straight heater pipe sections 4*a*, a corresponding pipe bend 4*b* and outer pipe sections 4*c*, wherein the pipe sections 4*a* lead into the expansion chamber 7*a* while the outer pipe sections 4*c* act on the regenerator 5.

Figure 2:
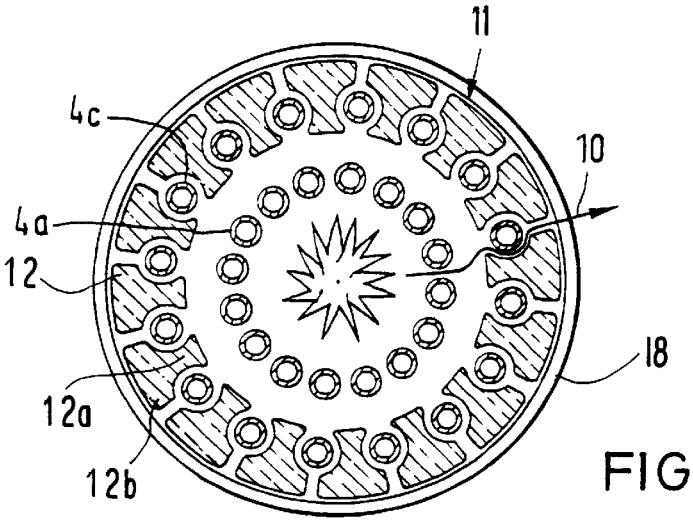
FIG. 2 is a detailed cross-sectional view through the heater head approximately on the line II—II in FIG. 1.
Figure 3:
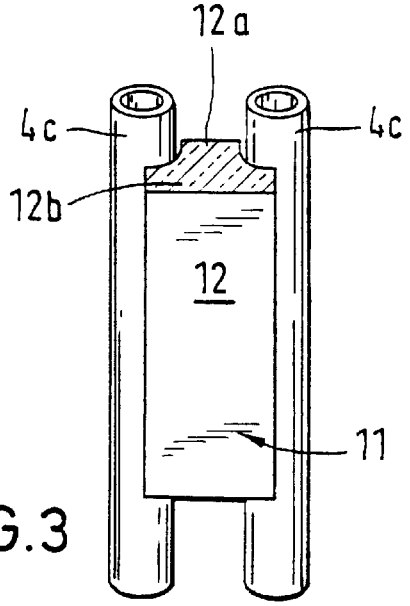
FIG. 3 is a diagrammatic perspective view of an element of the ceramic backing.
Figure 4:
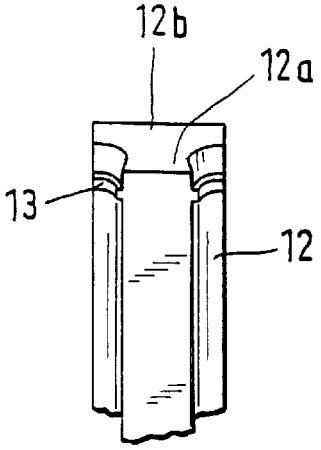
FIG. 4 is a detailed cross-sectional view of the ceramic backing.

As appears in particular in FIG. 2, the inner pipe sections 4*a* are arranged geometrically comparatively close to one another, while the outer pipe sections 4*c* are comparatively widely spread. The inner pipe sections 4*a* provided good flow conditions for the exhaust gas, whose flow path is indicated by an arrow 10 in FIGS. 1 and 2.

In order to obtain an equally good flow path for the pipe sections 4*c* further away from one another, these are provide with a ceramic backing generally denoted 11. This ceramic backing 11 consists of individual ceramic profiled elements 12 approximately T-shaped in cross-section with a T limb 12*a* running from the inside to the outside and a T crosspiece 12*b*, which lies on the outside of the pipe sections 4*c*, leaving a gap.

This gap formation is achieved in that the inner surfaces of the ceramic profiled elements 12 comprises ribs 13 in the transition region from the T limb 12*a* to the crosspiece 12*b*, which bear directly on the pipe sections 4*c*. The same flow conditions in the bathing of the pipe sections 4*c* by the exhaust gases are thereby achieved as in the bathing of the inner pipe sections 4*a*.

In order to achieve favorable transverse flow in the region of the pipe sections 4*c* a ceramic ring cover 14 is fitted over the top according to the invention and comprises a fixing rim 15 for the head regions of the ceramic elements 12.

Figure 5:
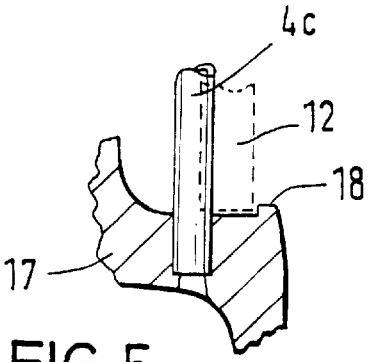
FIG. 5 is a detailed cross sectional view through the foot region of a pipe provided with the ceramic backing.
Figure 6:
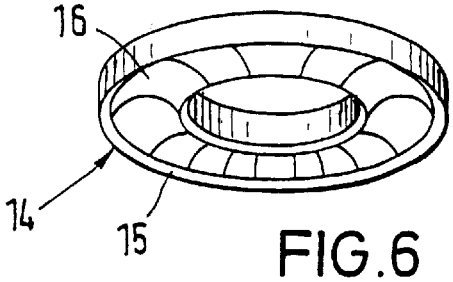
FIG. 6 is a diagrammatic perspective view of the ceramic head cover.

In FIG. 5 it is further shown how the foot region of the individual ceramic elements 12 is positioned in the housing wall 17, where a fixing rim 18 can be provided which retains the corresponding foot regions.

Figure 7:
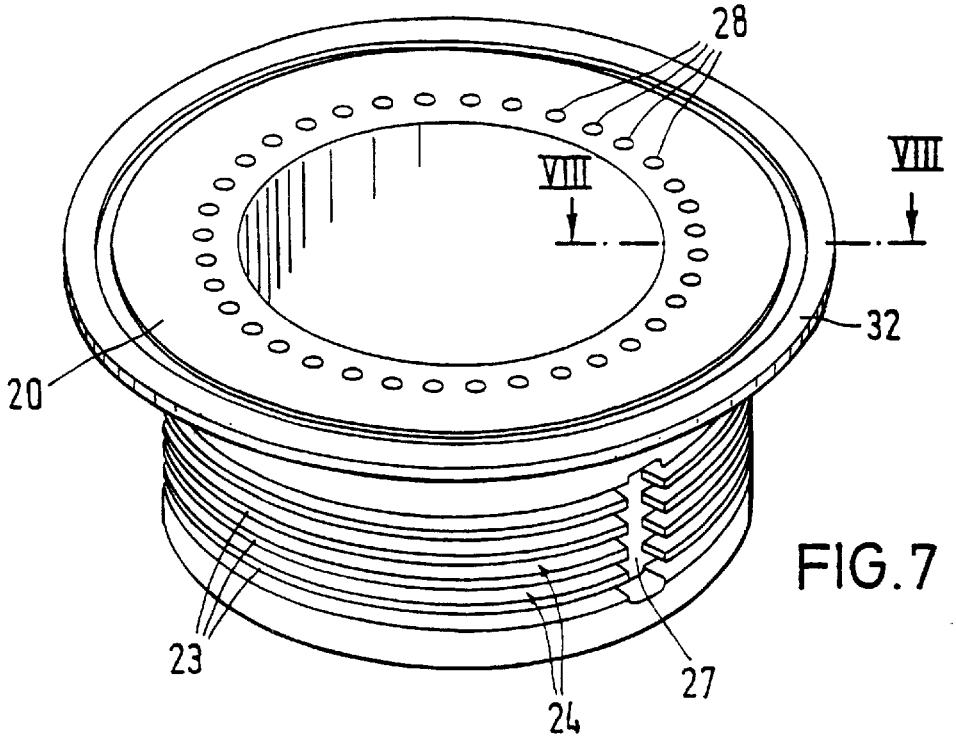
FIG. 7 is a diagrammatic perspective view of the cooling body and FIG. 8 is a detailed cross-sectional view taken along the line VIII—VIII in FIG. 7 through part of the region of the housing with the cooling body.
Figure 8:
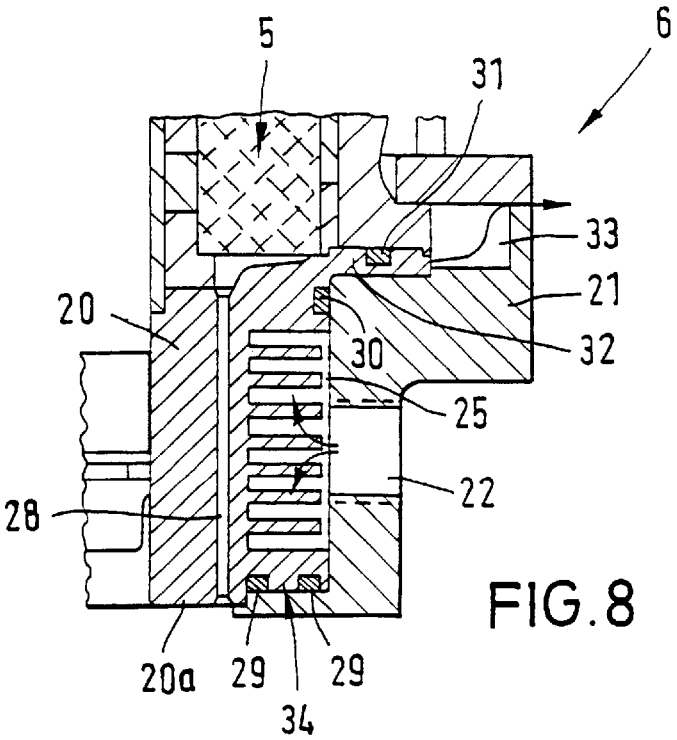

The cooler 6 of the Stirling engine 1 shown in FIG. 7 consists essentially of a light metal cooling block 20, which is fitted in a pot-shaped housing 21, which has the inlet 22 and the spatially opposite cooling water outlet not shown in more detail in FIG. 8.

The cooling block 20 is formed as a light metal body and comprises a plurality of parallel, outer, surrounding radial ribs 23, which form flow channels 24 therebetween and which make a comparatively narrow gap 25 with the inner wall of the housing 21, which is markedly smaller than the width of each flow channel 24. Two axial grooves 26 are provided in the cooling body on the two sides in the region of the cooling water inlet 22 and the opposite cooling water outlet, bridging over all of the radial ribs 23 and through which the cooling water is distributed to the individual flow channels 24 and from which it is received.

Set further to the inside the cooling block 20 has a plurality of axial bores 28, which could be a plurality of ribs, which represent the corresponding flow channels for the working medium to be cooled.

In order to seal the cooling block 20 optimally relative to the adjacent components it has in the illustrated example two axial seals 29 at the underside 20*a* facing the pot bottom, a radial seal 30 and again an axial seal 31 on its upper side, which is formed as a radially outwardly facing sealing collar 32, as appears in particular from FIG. 8.

Finally the edge region 33 of the housing 21 cooperating with the collar 32 of the cooling body 20 and likewise the region 34 lying between the two pot bottom seals 29 can be provided with a drain groove or the like, in order to take off leakage cooling water, which is only suggested in FIG. 8.

Naturally the described embodiments can be modified in many respects, without departing from the basic concept.

What is claimed is:

1. A Stirling engine with a cylinder head comprising a cooler (6);

a plurality of heating pipes (4) for heating of the cylinder head, said heating pipes having an approximately U-shape and including outwardly facing pipe sections (4*c*) through which a working medium flows; and a ceramic backing (11) arranged at least locally next to the outwardly facing pipe sections (4*c*) to optimize a heating gas flow (10) around the outwardly facing pipe sections (4*c*).

2. The Stirling engine as defined in claim 1, wherein the ceramic backing (11) comprises a plurality of T-shaped ceramic profiled elements (12) and each of said T-shaped ceramic profiled elements (12) comprises a T-crosspiece (12*b*) exteriorly covering at least two of said outwardly facing pipe sections (4*c*) and a T-limb (12*a*) extending from said T-crosspiece interiorly between adjacent ones of said outwardly facing pipe sections (4*c*).

3. The Stirling engine as defined in claim 2, wherein each of said T-shaped ceramic profiled elements (12) is provided with spacers (13) for circulation or through-flow and said spacers (13) are arranged on inner surfaces of said T-shaped ceramic profiled elements in a transition region between said T-limb (12*a*) and said T-crosspiece (12*b*).

4. The Stirling engine as defined in claim 1, further comprising a ceramic ring cover (14) for a curved head region **(4*b*) of the heating pipes (4)**.

5. The Stirling engine as defined in claim 4, wherein said ceramic ring cover (14) has an inner surface (16), said curved head region **(4*b*) has an outer surface and said ceramic ring cover (14) comprises a head disc with flow webs (15) so that no space is present between the inner surface (16) of the ceramic ring cover (14) and the outer surface of the curved head region (4*b*)**.

6. The Stirling engine as defined in claim 5, further comprising means for holding the ceramic backing (11) and wherein said means for holding the ceramic backing (11) comprises a fixing rim (15) provided on the ceramic ring cover (14) and another fixing rim (18) provided on a housing wall (17) for retaining head and foot regions of ceramic elements (12) of the ceramic backing (11).

7. The Stirling engine as defined in claim 1, wherein the cooler (6) comprises a pot-like housing (21) and a light metal body (20) arranged in the pot-like housing, the light metal body (20) has radial ribs (23) for flow through of a coolant and a spacing between adjoining pairs of the radial ribs (23) is greater than a gap (25) between an inner wall of the pot-like housing (21) and an outer bounding wall of the radial ribs (23).

8. The Stirling engine as defined in claim 7, wherein the light metal body (20) is provided with at least two grooves (27) connecting said spacings between the radial ribs (23) for an inflow and outflow of said coolant.

9. The Stirling engine as defined in claim 8, wherein the light metal body (20) is provided with ring seals (29) at least on a bottom surface of the light metal body (20) adjacent to a bottom portion of the pot-like housing (21).

10. The Stirling engine as defined in claim 8, wherein the light metal body (20) is provided with an outwardly projecting sealing collar (32) and a ring seal (31) on an edge surface of the light metal body (20) facing the heating pipes (4).

* * * * *